United States Patent [19]

Stritzke

[11] Patent Number: 4,773,363

[45] Date of Patent: Sep. 27, 1988

[54] FIXED VALVE STEM OIL DEFLECTOR

[75] Inventor: Bernard G. Stritzke, Hanover Park, Ill.

[73] Assignee: Microdot Inc., Darien, Conn.

[21] Appl. No.: 44,709

[22] Filed: May 1, 1987

[51] Int. Cl.[4] ..... F01L 3/08

[52] U.S. Cl. ..... 123/188 P; 277/33; 277/163; 277/188 R

[58] Field of Search ..... 123/188 GC, 188 P; 277/33, 157, 163, 188 R, 212 R, 212 C

[56] References Cited

U.S. PATENT DOCUMENTS

| | | | |
|---|---|---|---|
| 2,157,867 | 5/1939 | Robertson et al. | 123/188 P |
| 3,326,562 | 6/1967 | Deuring | 123/188 P X |
| 3,333,578 | 8/1967 | Muller | 123/188 P |
| 3,884,210 | 5/1975 | Ferch | 123/188 GC |
| 4,124,220 | 11/1978 | Leone et al. | 123/188 GC X |
| 4,317,436 | 3/1982 | Barnhart et al. | 123/188 P |
| 4,509,473 | 4/1985 | Hamparian | 123/188 P X |

FOREIGN PATENT DOCUMENTS

| | | | |
|---|---|---|---|
| 96316 | 7/1980 | Japan | 123/188 P |
| 539154 | 12/1976 | U.S.S.R. | 123/188 P |

*Primary Examiner*—Tony M. Argenbright
*Attorney, Agent, or Firm*—Lyman R. Lyon

[57] ABSTRACT

An oil deflector adapted to be secured to the valve guide of an internal combustion engine comprises a generally cup-shaped molded plastic member having a seal element in a transverse end wall with lips engageable with both the valve and valve guide in sealing relation.

1 Claim, 1 Drawing Sheet

FIXED VALVE STEM OIL DEFLECTOR

BACKGROUND OF THE INVENTION

Valve stem oil deflectors are generally secured to the valve stem so as to reciprocate therewith. Such oil deflectors survive the extremely destructive environmental conditions internally of the valve chamber of an internal combustion engine by eliminating sliding, sealing contact between the deflector and the valve stem. However, such known oil deflectors have a basic deficiency in that the valve guide is not completely sealed from the ambient conditions within the valve chamber of the engine.

SUMMARY OF THE INVENTION

The instant invention relates to a high strength, inexpensive, easily assembled, molded thermosplastic valve stem oil deflector that is mounted on the valve guide of an internal combustion engine so as to positively seal the valve guide from the environment of the valve chamber. The oil deflector comprises a cup-shaped member having a neck portion that supports a resilient seal that slidably engages the reciprocable valve stem. The seal has a radially inwardly facing sealing surface that engages the valve stem and an axially facing sealing surface that engages the valve guide. A plurality of axially extending circumferentially spaced teeth on a skirt portion of the deflector retain the deflector on the valve guide.

DESCRIPTION OF THE INVENTION

Figure 1:
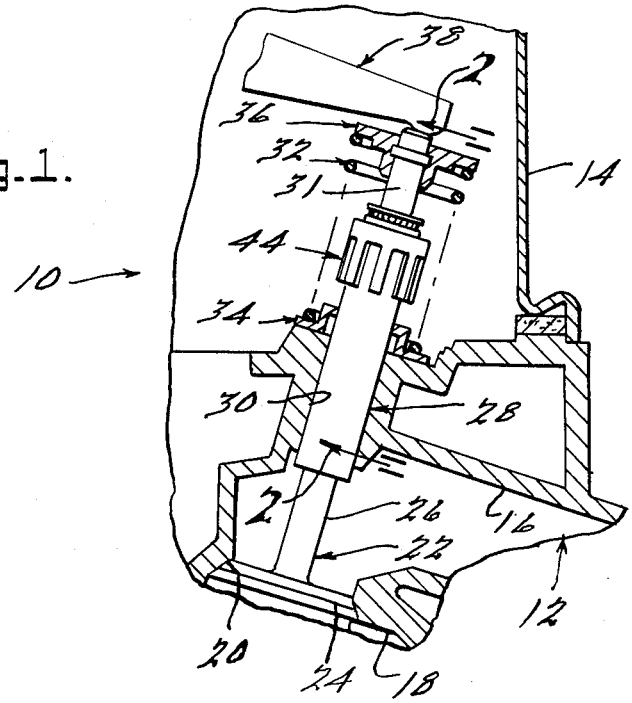
FIG. 1 is a fragmentary cross sectional view of a portion of a conventional internal combustion engine having a fixedly mounted oil deflector in accordance with a preferred embodiment of the present invention.
Figure 2:
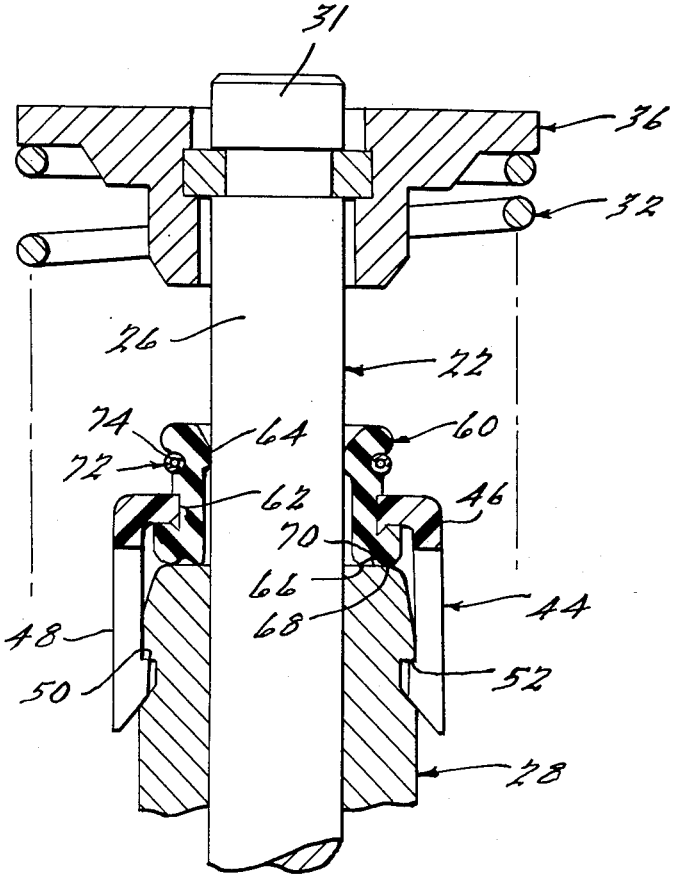
FIG. 2 is an enlarged cross sectional view taken substantially along the line 2—2 of FIG. 1.

Referring to FIG. 1 of the drawing, a conventional internal combustion engine 10 comprises a cylinder head 12 having a rocker arm cover 14 mounted thereon. The cylinder head 12 is provided with a passage 16 that communicates with a manifold (not shown) and a combustion chamber 18. The lower end of the passage 16 is provided with an annular valve seat 20 for seating of a conventional valve 22 having a head portion 24. The valve 22 has a stem section 26 that reciprocates in a valve guide 28 which is supported within a bore 30 in the cylinder head 12.

An upper end 31 of the valve stem 26 is surrounded by a helical compression spring 32 which is supported at the lower end thereof by an annular bushing or spring locator 34 coaxially disposed about the valve guide 28 and bearing against the cylinder head 12. The upper end of the spring 32 abuts against a spring retainer 36. A rocker arm 38 bears against the upper end 31 of the valve stem 26 and is adapted to effect reciprocal movement of the valve 22 in a manner well known in the art.

In accordance with the present invention, a cup-shaped oil deflector generally designated by the numeral 44, comprises a generally cylindrical body portion 46 of a molded plastic material which is relatively stiff, dimensionally stable, and resistant to heat up to at least approximately 350° F. One suitable material is glass filled Nylon which has been found to have the requisite heat resistant characteristics. However, it will be apparent that equivalent materials can be used in fabricating the body portion 46 of the deflector 44 noting that the material should be one that does not exhibit dimensional change due to heating and cooling.

In accordance with one feature of the instant invention, the body portion 46 of the deflector 44 is provided with a plurality of axially extending circumferentially spaced fingers 48 having locking shoulders 50 thereon that engage a peripheral groove 52 on the valve guide 28. The fingers 48 positively position the deflector 44 on the valve guide 28.

In accordance with another feature of the instant invention the deflector 44 is provided with a generally cylindrical seal element 60 positioned within an aperture 62 in the body portion 46 thereof. The seal element 60 has an annular radially inwardly facing sealing lip 64 that is slidably engageable with the valve stem 26. The seal element 60 also has a pair of circular, axially facing, radially spaced lips 66 and 68 that are sealingly engageable with an upper face 70 of the valve guide 28. It is to be noted that the length of the fingers 48 is calculated to effect compression of the lips 66 and 68 against the face 70 of the valve guide 28 in the manner of "O" rings. A garter spring 72 is disposed in an annular groove 74 in the outer periphery of the seal element 60 so as to maintain the lip 64 thereof in slidable yet sealing relation with the valve stem 26.

From the foregoing it should be apparent that oil is precluded from entry into the valve guide 28 by the sealing surfaces 64, 66 and 68 on the seal element 60 of the deflector 44 thereby preventing oil from entering into the combustion chamber 18 of the engine 10.

While the preferred embodiment of the invention has been disclosed, it should be appreciated that the invention is susceptible of modification without departing from the scope of the following claims.

I claim:

1. An oil deflector for attachment to the valve guide of an internal combustion engine or the like comprising a molded plastic cup having a generally cylindrical wall section and a transverse end wall, the end wall of said cup including an opening, a generally cylindrical seal element disposed in the opening in said cup, said seal element having an annular sealing lip on a radially inner surface thereof engageable with the stem of a valve of said engine in sliding relationship, said seal element having an axially compressible circular seal lip extending axially from a radial end face thereof engageable with said valve guide in sealing relation, the cylindrical wall portion of said deflector having a plurality of axially extending circumferentially spaced fingers thereon with end portions, respectively, engageable with said valve guide to maintain said deflector in fixed relation thereto and sized so as to effect compression of said circular seal lip.

* * * * *